US009826600B2

(12) United States Patent
Hillas

(10) Patent No.: US 9,826,600 B2
(45) Date of Patent: Nov. 21, 2017

(54) COMMUNICATION PROTOCOL FOR LIGHTING SYSTEM WITH EMBEDDED PROCESSORS AND SYSTEM OPERATING WITH THE PROTOCOL

(71) Applicant: PHILIPS LIGHTING HOLDING B.V., Eindhoven (NL)

(72) Inventor: Nicholaos Hillas, Willowbrook, IL (US)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 256 days.

(21) Appl. No.: 14/354,664

(22) PCT Filed: Oct. 23, 2012

(86) PCT No.: PCT/IB2012/055822

§ 371 (c)(1),
(2) Date: Apr. 28, 2014

(87) PCT Pub. No.: WO2013/061246

PCT Pub. Date: May 2, 2013

(65) Prior Publication Data

US 2014/0285105 A1 Sep. 25, 2014

Related U.S. Application Data

(60) Provisional application No. 61/552,495, filed on Oct. 28, 2011.

(51) Int. Cl.
*H05B 37/02* (2006.01)
*H05B 33/08* (2006.01)

(52) U.S. Cl.
CPC ..... *H05B 37/0245* (2013.01); *H05B 33/0869* (2013.01)

(58) Field of Classification Search
CPC ..... H05B 37/0245; H05B 33/0869
(Continued)

(56) References Cited

U.S. PATENT DOCUMENTS 5,769,527 A 6/1998 Taylor et al.
6,548,967 B1 * 4/2003 Dowling ..... G06Q 30/0201 315/307

(Continued)

FOREIGN PATENT DOCUMENTS

CN 1917519 A 2/2007
WO 2008070981 A2 6/2008

OTHER PUBLICATIONS

Japanese Office Action From Corresponding Japanese Application No. 2014-537782, Oct. 28, 2016 (5 pages).

(Continued)

*Primary Examiner* — Daniel D Chang
(74) *Attorney, Agent, or Firm* — Akarsh P. Belagodu

(57) ABSTRACT

A system includes a lighting unit, and a primary processor. The lighting unit includes a lighting module, and a lighting driver supplying power to the lighting module. The lighting module includes: one or more light sources, one or more sensors for sensing data indicating one or more operating parameters of the lighting module, and a secondary processor receiving the sensed data. The primary processor and the secondary processor communicate with each other according to a message-based communication protocol wherein each message communicated between the primary processor and the secondary processor has an identical message format and includes a command field and a response field wherein the response field is provided for indicating a response to a command.

22 Claims, 5 Drawing Sheets

(58) Field of Classification Search
USPC ..... 315/317, 318, 153, 362, 312, 292
See application file for complete search history.

(56) References Cited

U.S. PATENT DOCUMENTS

| | | | | |
|---|---|---|---|---|
| 2002/0047646 | A1* | 4/2002 | Lys | H05B 33/0803 315/312 |
| 2007/0273539 | A1 | 11/2007 | Gananathan | |
| 2008/0126752 | A1 | 5/2008 | Baker et al. | |
| 2008/0136334 | A1 | 6/2008 | Robinson et al. | |
| 2008/0265799 | A1* | 10/2008 | Sibert | H05B 37/0245 315/292 |
| 2010/0327766 | A1* | 12/2010 | Recker | H02J 9/02 315/291 |

OTHER PUBLICATIONS

Foreign NPL Cited in Japanese Office Action: Osamu Inada, "Mechanism of Communication by Echonet," Computer & Network Lan, Shares Company Ohm, Inc. May 1, 2004, vol. 22, No. 5, pp. 76-82.

* cited by examiner

500

| | | |
|---|---|---|
| | Forward/Command:<br>[SOF / MSGL] - [CMD / RESP] - ([DATA(0)]...[DATA(x)]} - [CRC2] - [(CRC1/2) / EOF]: payload of 6 bytes<br><br>Backward/Return:<br>[SOF / MSGL] - [CMD / RESP] - ([DATA(0)]...[DATA(x)]} - [CRC2] - [(CRC1/2) / EOF]: payload of 6 bytes | |
| 510 | SOF | Start of frame. The value is defined to be 0x01. |
| 520 | MSGL | Message length. Including from CMD to and including CRC2. |
| 530 | CMD | Single byte indicating the command.<br>Refer to table 2 (Commands table). |
| 540 | DATA(0)...<br>DATA(x) | Data could be up to 6 bytes included but not limited to zero length. The data must conform to the format expected for the defined command.<br>Refer to the table 2 (Commands table) for the data formats. |
| 550 | RESP | Type of response expected. It is possible that DATA would have zero lenght since the intention would be to gather information from the slave processor. Refer to the table 2 (Commands table). And Table 3 (Responses table). |
| 560 | CRC1 | Upper 8 bits of a CRC16 over complete frame (from CMD to the last data byte). Refer to the CRC calculation description. |
| 570 | CRC2 | Lower 8 bits of a CRC16 over complete frame (from CMD to the last data byte). Refer to the CRC calculation description. |
| 580 | EOF | End of frame is defined to be 4 (0x04). |

FIG. 5

COMMUNICATION PROTOCOL FOR LIGHTING SYSTEM WITH EMBEDDED PROCESSORS AND SYSTEM OPERATING WITH THE PROTOCOL

TECHNICAL FIELD

The present invention is directed generally to communications between embedded processors in electronic systems. More particularly, various inventive methods and apparatus disclosed herein relate to a high-speed communication protocol for small embedded processors in a lighting system.

BACKGROUND

Monitoring operating parameters as well as controlling input/output (I/O) and/or feedback circuits, such as pulse width modulation (PWM) circuits, of a power circuit/supply presents a challenge and can be expensive, especially over an isolation barrier. When using small embedded microcontrollers for system control, there are not many resources left for communication and command interface functions. This presents a challenge in terms of the processing time required to process a message or frame while maintaining data integrity. Data that needs to be communicated at a certain update rate is of particular concern. Thus, there is a need in the art for a communication protocol for resource-limited devices which can communicate data rapidly, flexibly, efficiently and reliably without consuming too many processing resources.

SUMMARY

The present disclosure is directed to inventive methods and apparatus for feedback and control in electronics systems, particularly a communication protocol supporting such feedback and control. For example, various embodiments relate to systems and methods that employ a symmetrical communication protocol for communications between embedded processors in electronics systems, particularly power electronics systems, and even more particular, lighting systems.

Generally, in one aspect, the invention relates to an apparatus that includes a lighting unit, an optical isolator and a primary processor. The lighting unit includes a lighting module and a lighting driver configured to supply power to the lighting module. The lighting module includes: one or more light sources, one or more sensors for sensing data indicating one or more operating parameters of the lighting module, and a secondary processor configured to receive the sensed data indicating the one or more operating parameters. The primary processor is configured to monitor the one or more operating parameters. The primary processor and the secondary processor communicate with each other via the optical isolator according to a message-based communication protocol wherein each message communicated between the primary processor and the secondary processor has an identical message format and includes a command field and a response field wherein the response field is provided for indicating a response to a command According to one or more embodiments, each message further includes: a start of frame field; an end of frame field; a message length field; and cyclical redundancy check (CRC) bits for an entire balance of the message except for the CRC bits themselves and the start of frame, end of frame, and message length fields.

According to one or more embodiments, the one or more operating parameters include a current provided to at least one of the one or more light sources, a voltage provided to at least one of the one or more light sources, and an operating temperature of the lighting module. In one or more versions of these embodiments, the one or more light sources include at least two light sources.

According to one or more embodiments, the command field includes a command selected from a set of allowed commands, wherein the set of allowed commands includes: setting a state of the secondary processor to one of a set of designated states; requesting an acknowledgement from the secondary processor indicating whether the lighting module is ready for operation; setting a pulse width modulation value for a pulse width modulator included in the lighting unit; and requesting that the secondary processor communicate a selected set of the sensed data from among a group of designated sets of sensed data. The set of allowed commands may further include setting the lighting module into a demonstration mode.

According to one or more versions of these embodiments, the set of designated states include an active state, a standby state, a reset state, a power down state, and a current monitor only state.

According to one or more versions of these embodiments, the one or more light sources include at least first and second light sources, and wherein the designated sets of sensed data include: first and second currents applied to the first and second light sources; currents from the first and second light sources and a first voltage applied to the first light source; the first and second currents applied to first and second light sources and a second voltage applied to the second light source; the first and second currents applied to the first and second light sources and a temperature of the lighting module; and the first and second currents applied to the first and second light sources and a pulse width modulation value for a pulse width modulator of the lighting unit.

According to one or more embodiments, the message format is: [SOF/MSGL]-[CMD/RESP]-([DATA(0)] . . . [DATA(x)]}-[CRC2]-[(CRC1/2)/EOF], where: SOF indicates a start of the message, MSGL indicates a length of the message, CMD indicates a specific command, RESP indicates a specific expected response, DATA indicates data associated with the specified command or response, CRC2 indicates a lower 8 bits of a 16 bit cyclical redundancy check value for the message, CRC1/2 indicates half of an upper 8 bits of the 16 bit cyclical redundancy check value for the message, and EOF indicates an end of the message.

According to one or more embodiments, the lighting unit further includes a pulse width modulator for adjusting an output level of the lighting driver, wherein the one or more operating parameters further a pulse width modulation value of the pulse width modulator.

The lighting unit further may include a second optical isolator configured to supply the feedback signal from the lighting module to the lighting driver.

Generally, in another aspect, the invention relates to a method that includes: at a secondary processor embedded in a lighting module that includes one or more light sources, receiving from a primary processor a first message communicated according to a message-based communication protocol wherein each message communicated between the primary processor and the secondary processor has an identical message format and includes a command field and a response field wherein the response field is provided for indicating a response to a command; executing a first operation at the lighting module in response to a first command included in the command field of the first message; sending from the secondary processor to a primary processor a second message according to the message-based communication protocol, wherein the second message includes in the response field a first response to the first command received in the first message.

According to one or more embodiments, the first command comprises a request that the secondary processor send to the primary processor selected data sensed at the lighting module indicating one or more operating parameters of the lighting module.

According to one or more versions of these embodiments, executing the first operation at the lighting module includes sensing the selected data and wherein the second message further includes the selected data.

As used herein for purposes of the present disclosure, the term "LED" should be understood to include any electroluminescent diode or other type of carrier injection/junction-based system that is capable of generating radiation in response to an electric signal. Thus, the term LED includes, but is not limited to, various semiconductor-based structures that produce light in response to current, light emitting polymers, organic light emitting diodes (OLEDs), electroluminescent strips, and the like. In particular, the term LED refers to light emitting diodes of all types (including semiconductor and organic light emitting diodes) that may be configured to generate radiation in one or more of the infrared spectrum, ultraviolet spectrum, and various portions of the visible spectrum (generally including radiation wavelengths from approximately 400 nanometers to approximately 700 nanometers). Some examples of LEDs include, but are not limited to, various types of infrared LEDs, ultraviolet LEDs, red LEDs, blue LEDs, green LEDs, yellow LEDs, amber LEDs, orange LEDs, and white LEDs (discussed further below). It also should be appreciated that LEDs may be configured and/or controlled to generate radiation having various bandwidths (e.g., full widths at half maximum, or FWHM) for a given spectrum (e.g., narrow bandwidth, broad bandwidth), and a variety of dominant wavelengths within a given general color categorization.

For example, one implementation of an LED configured to generate essentially white light (e.g., a white LED) may include a number of dies which respectively produce different spectra of electroluminescence that, in combination, mix to form essentially white light. In another implementation, a white light LED may be associated with a phosphor material that converts electroluminescence having a first spectrum to a different second spectrum. In one example of this implementation, electroluminescence having a relatively short wavelength and narrow bandwidth spectrum "pumps" the phosphor material, which in turn radiates longer wavelength radiation having a somewhat broader spectrum.

The term "light source" should be understood to refer to any one or more of a variety of radiation sources, including, but not limited to, LED-based light sources (including one or more LEDs as defined above), incandescent sources (e.g., filament lamps, halogen lamps), fluorescent sources, phosphorescent sources, high-intensity discharge sources (e.g., sodium vapor, mercury vapor, and metal halide lamps), lasers, other types of electroluminescent sources, pyroluminescent sources (e.g., flames), candle-luminescent sources (e.g., gas mantles, carbon arc radiation sources), photo-luminescent sources (e.g., gaseous discharge sources), cathode luminescent sources using electronic satiation, galvano-luminescent sources, crystallo-luminescent sources, kine-luminescent sources, thermo-luminescent sources, triboluminescent sources, sonoluminescent sources, radioluminescent sources, and luminescent polymers.

The term "lighting unit" is used herein to refer to an apparatus including one or more light sources of same or different types. A given lighting unit may have any one of a variety of mounting arrangements for the light source(s), enclosure/housing arrangements and shapes, and/or electrical and mechanical connection configurations. Additionally, a given lighting unit optionally may be associated with (e.g., include, be coupled to and/or packaged together with) various other components (e.g., control circuitry, which may include one or more drivers) relating to the operation of the light source(s). An "LED-based lighting unit" refers to a lighting unit that includes one or more LED-based light sources as discussed above, alone or in combination with other non LED-based light sources.

The terms "driver" and "lighting driver" ate used herein generally to refer to an apparatus for receiving input power for supplying that power in a format to one or more light sources to cause the light source(s) to produce light. In particular, an "LED driver" refers to an apparatus for receiving input power and supplying that power to a load of one or more LED-based light sources including one or more LEDs as discussed above to cause the one or more LED-based light sources to produce light.

The term "lighting module" is used herein to refer to elements of a lighting unit that may be driven by a lighting driver and may include one or more light sources, one or more sensors, and optionally a feedback circuit for providing a feedback signal for the lighting driver. In some cases, the lighting module represents elements of a lighting unit which are galvanically isolated from the lighting driver.

As used herein, "galvanic isolation" refers to the principle of isolating functional sections of electrical systems preventing the moving of charge-carrying particles from one section to another. There is no electric current flowing directly from a first section to a second section when the first and second sections are galvanically isolated from each other. Energy and/or information can still be exchanged between the sections by other means, e.g. capacitance, induction, electromagnetic waves, optical, acoustic, or mechanical means.

As used herein, an "optical isolator" is an electronic device designed to transfer electrical signals by utilizing light waves to provide coupling with electrical isolation/galvanic isolation between its input and output, and may sometimes also be referred to as an opto-isolator, photocoupler, or optocoupler.

The term "controller" is used herein generally to describe various apparatus relating to the operation of one or more light sources. A controller can be implemented in numerous ways (e.g., such as with dedicated hardware) to perform various functions discussed herein.

A "processor" is one example of a controller which employs one or more microprocessors that may be programmed using software (e.g., microcode) to perform various functions discussed herein. A controller may be implemented with or without employing a processor, and also may be implemented as a combination of dedicated hardware to perform some functions and a processor (e.g., one or more programmed microprocessors and associated circuitry) to perform other functions. Examples of controller components that may be employed in various embodiments of the present disclosure include, but are not limited to, conventional microprocessors, application specific integrated circuits (ASICs), and field-programmable gate arrays (FPGAs).

In various implementations, a processor or controller may be associated with one or more storage media (generically referred to herein as "memory," e.g., volatile and non-volatile computer memory such as RAM, PROM, EPROM, and EEPROM, floppy disks, compact disks, optical disks, magnetic tape, etc.). In some implementations, the storage media may be encoded with one or more programs that, when executed on one or more processors and/or controllers, perform at least some of the functions discussed herein. Various storage media may be fixed within a processor or controller or may be transportable, such that the one or more programs stored thereon can be loaded into a processor or controller so as to implement various aspects of the present invention discussed herein. The terms "program" or "computer program" are used herein in a generic sense to refer to any type of computer code (e.g., software or microcode) that can be employed to program one or more processors or controllers.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

FIG. 5 illustrates one embodiment of a message format for one embodiment of a symmetrical message based communication protocol that may be employed by the primary and secondary processors of FIGS. 1-3.

DETAILED DESCRIPTION

As discussed above, monitoring parameters as well as controlling input/output (I/O) and/or feedback circuits, such as pulse width modulation (PWM) circuits, of a power circuit/supply presents a challenge and can be expensive, especially over an isolation barrier. When using small embedded microcontrollers for system control, there are not many resources left for communication and command interface functions. This presents a challenge in terms of the processing time required to process a message or frame while maintaining data integrity. Data that needs to be communicated at a certain update rate is of particular concern.

More generally, Applicant has recognized and appreciated that it would be beneficial to provide a communication protocol for such resource-limited devices which can communicate data rapidly, flexibly, efficiently and reliably without consuming too many processing resources.

In view of the foregoing, various embodiments and implementations of the present invention are directed to a flexible, efficient, and reliable high-speed communication protocol for use with small microcontrollers to perform feedback & control in power electronics systems, for example in lighting systems, and to systems and methods which employ such a protocol.

Figure 1:
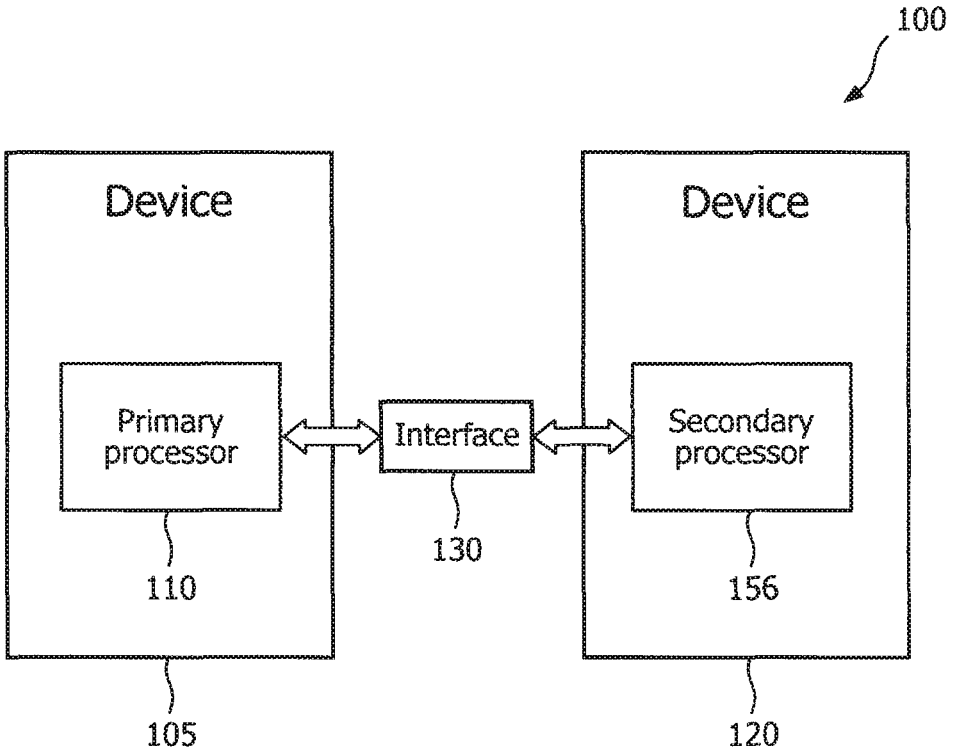
FIG. 1 is a high level functional block diagram illustrating communication between a primary processor and a secondary processor in embedded devices.

FIG. 1 is a high level functional block diagram illustrating communication between a primary processor and a secondary processor in embedded devices. In particular, FIG. 1 illustrates a system 100 including a first device 105 and a second device 120. First device 105 includes an embedded primary processor 110, and second device 120 includes an embedded secondary processor 156. Primary processor 110 and secondary processor 156 communicate with each other across an interface 130.

In some beneficial embodiments, primary processor 110 and secondary processor 156 may each be small and inexpensive devices which perform a number of functions such that they have limited resources for communication and command interface functions. In some embodiments, In some embodiments primary processor 110 and secondary processor 156 may need to communicate a certain amount of data within a specified time interval to support the interoperability requirements of first device 105 second device 120. Furthermore, in some embodiments interface 130 may be somewhat bandwidth constrained, for example when interface 130 provides a galvanic isolation barrier between first device 105 and second device 120.

Accordingly, as will be described in much greater detail below, primary processor 110 and secondary processor 156 may communicate with each other according to a symmetrical message-based communication protocol which exhibits a desired degree of speed, reliability, and flexibility. Example embodiments of such a message-based communication protocol, and example systems and methods that may employ such a message-based communication protocol, will be described below in the context of a lighting system. This particular context has certain communication requirements that may benefit from various features of such a symmetrical message-based communication protocol, and accordingly the use of this context as a concrete example will clearly illustrate various aspects and benefits of the protocol. However, it should be understood and appreciated that the symmetrical message-based communication protocol as described below has applicability and may be employed in contexts other than that of a lighting system.

Figure 2:
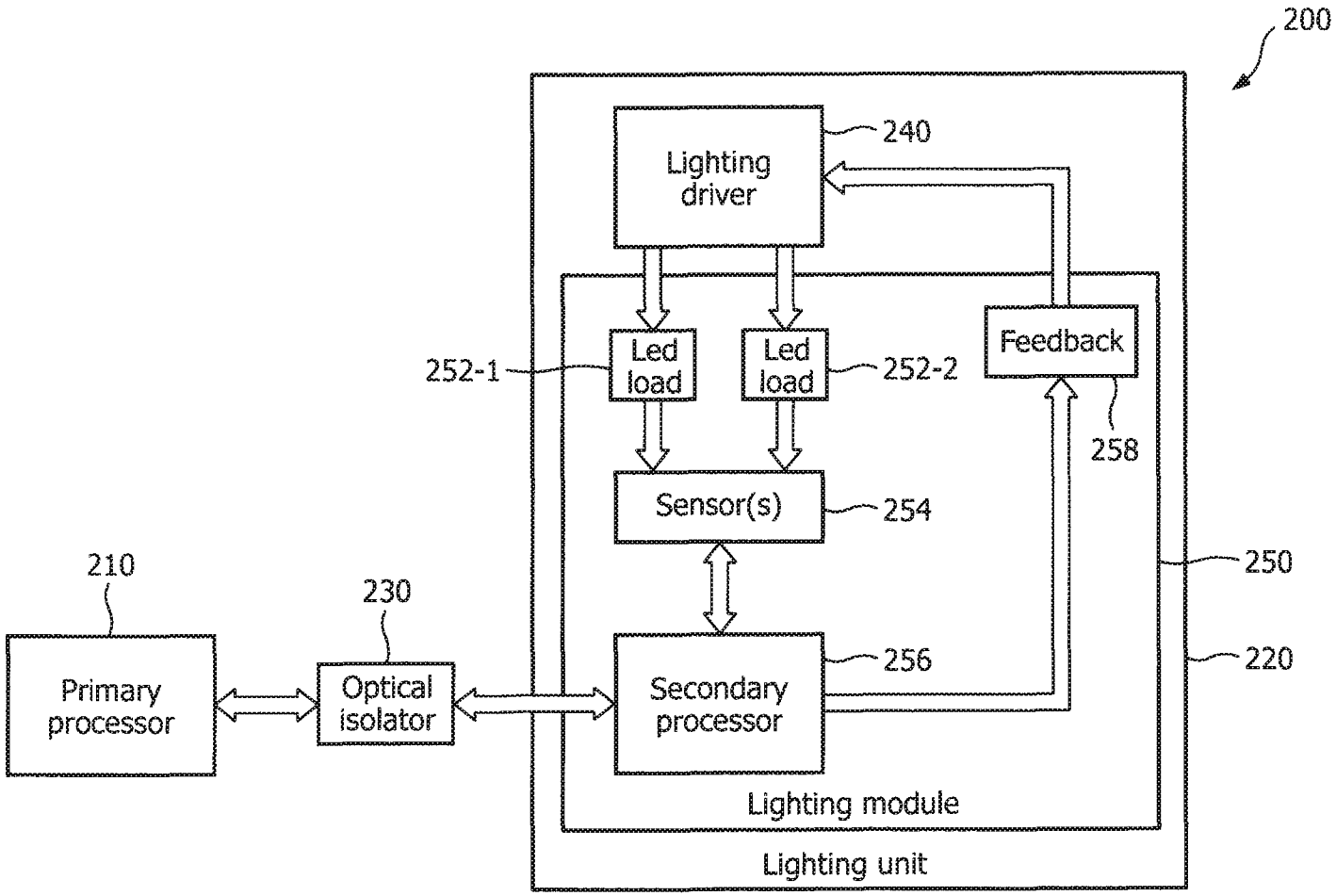
FIG. 2 is a functional block diagram of one embodiment of a lighting system.

FIG. 2 is a functional block diagram of one embodiment of a lighting system 200 that may employ a symmetrical message-based communication protocol. Lighting system 200 includes a primary processor 210, a lighting unit 220, and an optical isolator 230. Lighting unit 220 includes a lighting driver 240 and a lighting module 250. Lighting module 250 includes first and second LED loads 252-1 and 252-2, one or more sensor(s) 254, a secondary processor 256, and a feedback circuit 258. First and second LED loads 252-1 and 252-2 each include one or more LEDs, for example a plurality of LEDs connected in series with each other and referred to here as an LED string. First and second LED loads 252-1 and 252-2 may each include one or more LED strings.

In operation, lighting driver 240 is configured to supply power to lighting module 250, including first and second LED loads 252-1 and 252-2. In particular, lighting driver 240 supplies an output current to first and second LED loads 252-1 and 252-2 to drive the LEDs included therein at a desired operating point to cause lighting module 250 to provide a desired light output. In some embodiments, lighting driver 240 may respond to a feedback signal supplied by feedback circuit 258 to control the output current which it supplies to first and second LED loads 252-1 and 252-2.

Sensor(s) 254 sense one or more operating parameters of lighting module 250, and supply this sensed data to secondary processor 256. Such operating parameter(s) may include a current and/or a voltage supplied to each of the first and second LED loads 252-1 and 252-2, and/or an operating temperature of lighting module 250. In some embodiments, sensor(s) 254 may include one or more analog-to-digital converter (ADC) for converting a measured value (e.g., a current, a voltage, or a temperature) to digital sensed data which may be processed by secondary processor 256.

Feedback circuit 258 supplies a feedback signal to lighting driver 240 which lighting driver 240 may employ to adjust the output current that it supplies to first and second LED loads 252-1 and 252-2. In some embodiments, feedback circuit 258 may receive a control signal from secondary processor 256 from which it generates the feedback signal. In some embodiments, feedback circuit 258 may comprise a proportional integrator (PI) feedback circuit which supplies a pulse width modulation value for a pulse width modulator of lighting driver 240 to adjust the output current that lighting driver 240 supplies to first and second LED loads 252-1 and 252-2.

Secondary processor 256 also communicates with primary processor 210 to receive commands which secondary processor 256 execute to control one or more operations of lighting unit 240, and lighting module 250 in particular. For example, secondary processor 256 may receive one or more commands from primary processor 210 to sense data for certain operating parameters of lighting unit 240, and supply this sensed data to primary processor 210. In response to sensed data and/or one or more commands from primary processor 210, secondary processor 256 may control parameters of feedback circuit 258 to adjust a feedback signal supplied to lighting driver 240, thereby also affecting the output current that is supplied by lighting driver 240 to first and second LED loads 252-1 and 252-2.

In some embodiments, lighting driver 240 may be galvanically isolated from lighting module 250. For example, lighting driver 240 may supply its output current to lighting module 250 via an isolation transformer, and lighting module 250 may supply its feedback signal to lighting driver 240 via a second optical isolator.

Optical isolator 230 provides an interface between primary processor 210 and secondary processor 256. Optical isolator 230 allows communication between primary processor 210 and secondary processor 256, while also galvanically isolating primary processor 210 and lighting module 250 from each other. Primary processor 210 and secondary processor 256 may communicate with each via optical isolator 230 to exchange commands, responses and data. Beneficially, primary processor 210 communicates with secondary processor 256 according to a symmetrical message-based communication protocol which exhibits a desired degree of speed, reliability, and flexibility. Example embodiments of such a message-based communication protocol, and example systems and methods that may employ such a message-based communication protocol, will be described in greater detail below. Via this communication protocol, primary processor 210 cooperates with secondary processor 256 to sense and adjust operating parameters of lighting unit 220.

Although FIG. 2 illustrates an embodiment wherein lighting unit 220 is an LED-based lighting unit, in other embodiments lighting unit 220 may employ other light sources, including bit not limited to incandescent sources (e.g., filament lamps, halogen lamps), fluorescent sources, phosphorescent sources, high-intensity discharge sources (e.g., sodium vapor, mercury vapor, and metal halide lamps), lasers, other types of electroluminescent sources, pyroluminescent sources (e.g., flames), candle-luminescent sources (e.g., gas mantles, carbon arc radiation sources), photo-luminescent sources (e.g., gaseous discharge sources), cathode luminescent sources using electronic satiation, galvano-luminescent sources, crystallo-luminescent sources, kine-luminescent sources, thermo-luminescent sources, triboluminescent sources, sonoluminescent sources, radioluminescent sources, and luminescent polymers. In some of these embodiments, galvanic isolation between primary processor and lighting module 250 may not be required. In those embodiments, optical isolator 230 may be omitted, and primary processor 210 and secondary processor 256 may be connected directly together for communication.

Although FIG. 2 illustrates an embodiment with only one lighting unit 220, in other embodiments, lighting system 200 may include a plurality of lighting units 220 which communicate with primary processor 210, each according to a symmetrical message-based communication protocol as described below.

Figure 3:
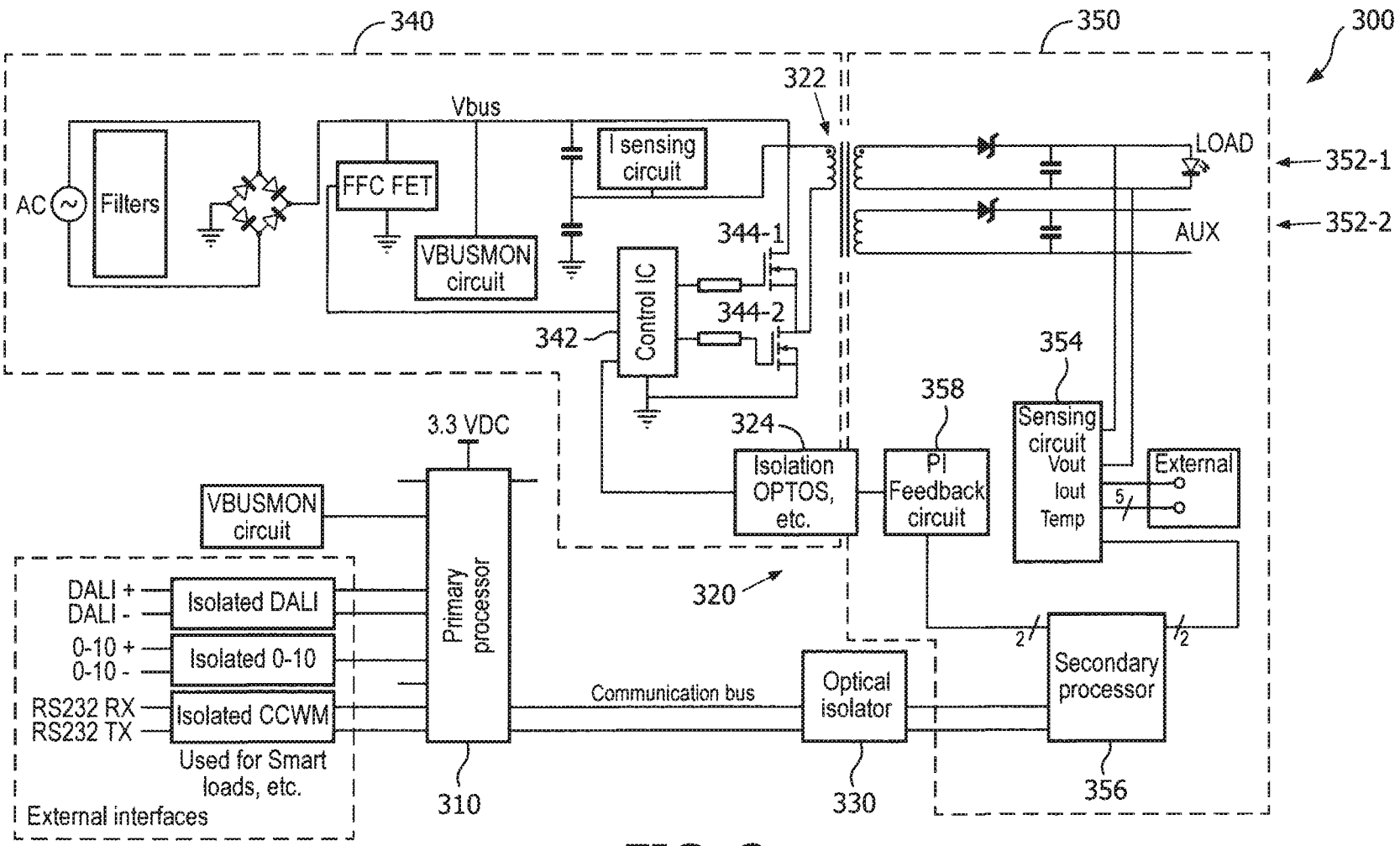
FIG. 3. is a schematic diagram of one embodiment of a lighting system.

FIG. 3. is a schematic diagram of one embodiment of a lighting system 300, which may be one example of lighting system 200. Lighting system 300 includes a primary processor 310, a lighting unit 320, and a first optical isolator 330. Lighting unit 320 includes a lighting driver 340 and a lighting module 350. Lighting module 350 includes first and second LED loads 352-1 and 352-2, one or more sensor(s) 354, a secondary processor 356, and a feedback circuit 358. First and second LED loads 352-1 and 352-2 each include one or more LEDs, for example a plurality of LEDs connected in series with each other and referred to here as an LED string. First and second LED loads 352-1 and 352-2 may each include one or more LED strings.

In operation, lighting driver 340 is configured to supply power to lighting module 350, including first and second LED loads 352-1 and 352-2. In particular, lighting driver 340 supplies an output current to first and second LED loads 352-1 and 352-2 to drive the LEDs included therein at a desired operating point to cause lighting module 350 to provide a desired light output. In some embodiments, lighting driver 340 may respond to a feedback signal supplied by feedback circuit 358 to control the output current which it supplies to first and second LED loads 352-1 and 352-2. In lighting unit 300, lighting driver 340 supplies an output current to first and second LED loads 352-1 and 352-2 via an isolation transformer 322 to provide galvanic isolation between lighting driver 340 and lighting module 350.

Sensor(s) 354 sense one or more operating parameters of lighting module 350, and supply this sensed data to secondary processor 356. Such operating parameter(s) may include a current and/or a voltage supplied to each of the first and second LED loads 352-1 and 352-2, and/or an operating temperature of lighting module 350.

In some embodiments, sensor(s) 354 may include one or more analog-to-digital converter (ADC) for converting a measured value (e.g., a current, a voltage, or a temperature)

to digital sensed data which may be processed by secondary processor 356. In some embodiments, the ADC may be an SRM8S903K ADC. In some embodiments, the ADC may perform an ADC conversion in 2.33 μsec. When supplied with a 5 volt supply and clocked at 6 MHz. In that case, in some embodiments each ADC may be able to read ADC values and store the corresponding data into associated memory space in 10 μsec. In that case, in some embodiments where secondary processor 356 requires another 10 μsec. to process a received message, and has a worst case setup latency time of 5 μsec., this adds up to a total time period of 50 μsec. for processing a data payload, satisfying a requirement of continuously transferring a data payload in 200 μsec.

Feedback circuit 358 supplies a feedback signal to lighting driver 340 which lighting driver 340 may employ to adjust the output current that it supplies to first and second LED loads 352-1 and 352-2. In some embodiments, feedback circuit 358 may receive a control signal from secondary processor 356 from which it generates the feedback signal. In some embodiments, feedback circuit 358 may comprise a proportional integrator (PI) feedback circuit which supplies a pulse width modulation value for a pulse width modulator of lighting driver 340 (which may include controller 342 and switching devices 344-1 and/or 344-2) to adjust the output current that lighting driver 340 supplies to first and second LED loads 352-1 and 352-2. In lighting unit 300, lighting driver 340 supplies an output current to first and second LED loads 352-1 and 352-2 via an isolation transformer 322 to provide galvanic isolation between lighting driver 340 and lighting module 350. In lighting unit 300, feedback circuit 358 provides its feedback signal to lighting driver 340 via a second optical isolator 324 to provide galvanic isolation between lighting driver 340 and lighting module 350.

Secondary processor 356 also communicates with primary processor 310 to receive commands which secondary processor 356 execute to control one or more operations of lighting unit 340, and lighting module 350 in particular. For example, secondary processor 356 may receive one or more commands from primary processor 310 to sense data for certain operating parameters of lighting unit 340, and supply this sensed data to primary processor 310. In response to sensed data and/or one or more commands from primary processor 310, secondary processor 356 may control parameters of feedback circuit 358 to adjust a feedback signal supplied to lighting driver 340, thereby also affecting the output current that is supplied by lighting driver 340 to first and second LED loads 352-1 and 352-2.

Optical isolator 330 provides an interface between primary processor 310 and secondary processor 356. Optical isolator 330 allows communication between primary processor 310 and secondary processor 356, while also galvanically isolating primary processor 310 and lighting module 350 from each other. Primary processor 310 and secondary processor 356 may communicate with each via optical isolator 330 to exchange commands, responses and data. Beneficially, primary processor 310 communicates with secondary processor 356 according to a symmetrical message-based communication protocol which exhibits a desired degree of speed, reliability, and flexibility. Example embodiments of such a message-based communication protocol will be described in greater detail below. Via this communication protocol, primary processor 310 cooperates with secondary processor 356 to sense and adjust operating parameters of lighting unit 320.

In an example embodiment, primary processor 310 and secondary processor 356 may each include a universal synchronous receiver/transmitter (UART) for communicating with each other. In a beneficial arrangement, the signal is a serial stream than can be handled with a normal UART that is capable of data transmission and reception speeds of up to 500 kbps. Assuming that in an example embodiment that lighting system 300 has a requirement of continuously transferring a data payload in 200 μsec, then a data rate of 500 kbps implies that maximum message length of 10 bytes (assuming that one start bit and one stop bit are included for each 8-bit byte). Furthermore, beneficially the physical interface between primary processor 310 and secondary processor 356, including e.g., optical isolator 330, is able to support an isolated 1 Mbps buffered data transfer rate to guard against excessive distortion at the pins of the primary processor 310 and secondary processor 356, respectively.

In that case, in some embodiments the physical communication settings for communication between primary processor 310 and secondary processor 356 may be as defined by Table 1 below:

TABLE 1

| Wired Interface: | |
|---|---|
| Baud Rate: | |
| 500 Kb/s | |
| Parity | |
| None | |
| Data bits | 8 |
| Stop bits | 1 |
| Flow Control | |
| None | |

In an example embodiment, primary processor 310 and secondary processor 356 may each operate at a clock speed of 16 MHz, implying a processor instruction period of 62.5 nsec.

Although FIG. 3 illustrates an embodiment wherein lighting unit 320 is an LED-based lighting unit, in other embodiments lighting unit 320 may employ other light sources, including bit not limited to incandescent sources (e.g., filament lamps, halogen lamps), fluorescent sources, phosphorescent sources, high-intensity discharge sources (e.g., sodium vapor, mercury vapor, and metal halide lamps), lasers, other types of electroluminescent sources, pyroluminescent sources (e.g., flames), candle-luminescent sources (e.g., gas mantles, carbon arc radiation sources), photo-luminescent sources (e.g., gaseous discharge sources), cathode luminescent sources using electronic satiation, galvano-luminescent sources, crystallo-luminescent sources, kine-luminescent sources, thermo-luminescent sources, triboluminescent sources, sonoluminescent sources, radioluminescent sources, and luminescent polymers. In some of these embodiments, galvanic isolation between primary processor and lighting module 350, and between lighting driver 340 and lighting module 350 may not be required. In those embodiments, optical isolators 330 and 324 may be omitted, and primary processor 310 and secondary processor 356 may be connected directly together for communication.

Although FIG. 3 illustrates an embodiment with only one lighting unit 320, in other embodiments, lighting system 300 may include a plurality of lighting units 320 which communicate with primary processor 310, each according to a symmetrical message-based communication protocol as described below.

Figure 4:
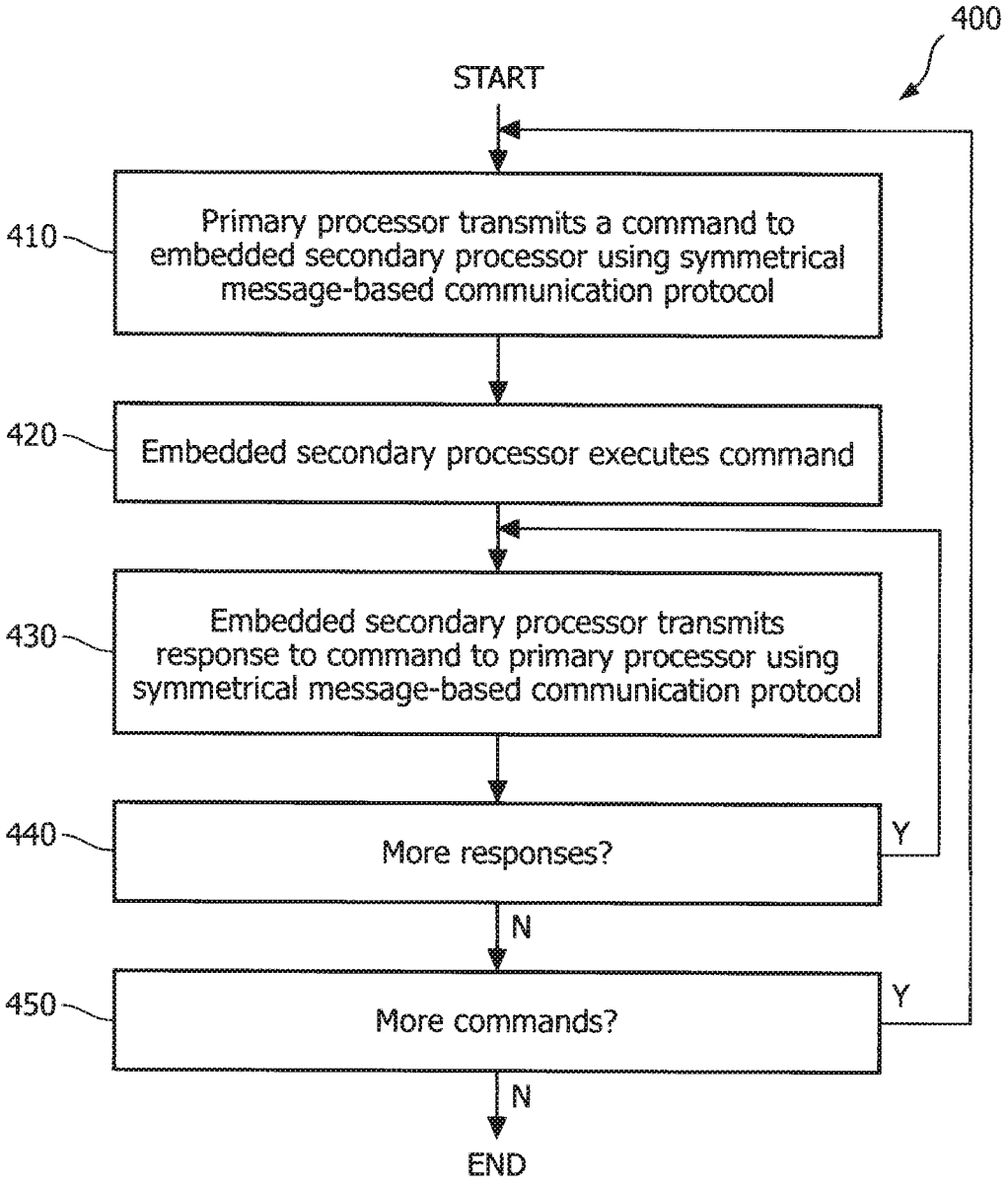
FIG. 4 is a flowchart illustrating example communications between a primary processor and a secondary processor such as the primary and secondary processors of FIGS. 1-3.

FIG. 4 is a flowchart illustrating an example of a process 400 of communication between a primary processor and a secondary processor, such as the primary and secondary processors of FIGS. 1-3. Process 400 may be executed by primary and secondary processors in any of the lighting systems 200 and 300.

In an operation 410, a primary processor transmits a message to an embedded secondary processor according to a symmetrical message-based communication protocol. The message includes a command for an operation to be executed by the secondary processor. Embodiments of the symmetrical message-based communication protocol will be described in greater detail below. The command may be selected from a set of allowed commands. In some embodiments, the set of allowed commands includes: (1) setting a state of the secondary processor to one of a set of designated states; (2) requesting an acknowledgement from the secondary processor indicating whether a lighting module to which the secondary processor belongs is ready for operation; (3) setting a pulse width modulation value for a pulse width modulator included in a lighting unit to which the secondary processor belongs; (4) requesting that the secondary processor communicate a selected set of the sensed data from among a group of designated sets of sensed data; and (5) setting the lighting module into a demonstration mode.

In some embodiments, the set of designated states for the secondary processor include an active state, a standby state, a reset state, a power down state, and a current monitor only state.

In some embodiments, the designated sets of sensed data include: first and second currents applied to first and second light sources of a lighting module to which the secondary processor belongs; the first and second currents applied to the first and second light sources and a first voltage applied to the first light source; the first and second currents applied to the first and second light sources and a second voltage applied to the second light source; the first and second currents applied to the first and second light sources and a temperature of the lighting module; and the first and second currents applied to the first and second light sources and a pulse width modulation value of a pulse width modulator included in a lighting unit to which the secondary processor belongs.

In an operation 420, the embedded secondary processor executes the command received in operation 410. In some embodiments, this may including (1) setting a state of the secondary processor to one of a set of designated states; (2) setting a pulse width modulation value for a pulse width modulator included in a lighting unit to which the secondary processor belongs; (4) gathering a selected set of the sensed data from among a group of designated sets of sensed data; and (5) setting the lighting module into a demonstration mode.

In some embodiments, the embedded secondary processor may set itself to a designated state selected from an active state, a standby state, a reset state, a power down state, and a current monitor only state.

In an operation 430, the embedded secondary processor transmits a message to the primary processor according to the symmetrical message-based communication protocol. The message may include a response to a previously-received command sent from the primary processor to the secondary processor in operation 410. In some embodiments, the response may include sensed data requested by the primary processor in the previously-received command. In some embodiments, the response may include an acknowledgement that the lighting unit is ready for operation.

In an operation 440, it is determined whether additional responses should be sent from the secondary processor to the primary processor. This may include communicating to the primary processor periodic updates of sensed data such as operating current(s), voltage(s), temperature, etc. of the lighting module. If additional responses should be sent, then the process returns to operation 430.

In an operation 450, it is determined whether additional commands should be sent from the primary processor to the secondary processor. If additional commands should be sent, then the process returns to operation 430.

As noted above, lighting systems 200 and 300, and process 400, beneficially employ a symmetrical message-based communication protocol. Beneficially, the protocol may employ message frames each including a message complying with a defined message format. Beneficially, the protocol is symmetrical in the sense that that message format is the same for both outbound messages and inbound messages, whether viewed from the standpoint of a primary processor or a secondary processor.

A detailed explanation of an embodiment of the symmetrical message-based communication protocol will now be provided in the context of the lighting system 300 as described above and shown in FIG. 3. In particular, in the example lighting system, it is assumed that sensor(s) 354 include one or more ADCs for converting one or more measured values (e.g., current, voltage, and/or temperature) to digital sensed data which may be processed by secondary processor 356. In some embodiments, the ADC may perform an ADC conversion in 2.33 μsec. In that case, in some embodiments each ADC may be able to read ADC values and store the corresponding data into associated memory space in 10 μsec. In that case, in some embodiments where secondary processor 356 requires another 10 μsec. to process a received message, and has a worst case setup latency time of 5 μsec., this adds up to a total time period of 50 μsec. for processing a data payload, satisfying a requirement of continuously transferring a data payload in 200 μsec. Furthermore, primary processor 310 and secondary processor 356 may each include a universal synchronous receiver/transmitter (UART) for communicating with each other with data transmission and reception speeds of up to 500 kbps. The physical communication settings for communication between primary processor 310 and secondary processor 356 may be as defined by Table 1 above. Additionally, it is assumed that lighting system 300 has a requirement of continuously transferring a data payload in 200 μsec.

In that case, a data rate of 500 kbps implies that maximum message length of 10 bytes (assuming that one start bit and one stop bit are included for each 8-bit byte).

With these example values in mind, a symmetrical message-based communication protocol will now be described which can be employed by primary processor 310 and secondary processor 356 to satisfy these communications requirements.

FIG. 5 illustrates one embodiment of a message format 500 for one embodiment of a symmetrical message based communication protocol. As illustrated in FIG. 5, each message from primary processor 310 to secondary processor 356 (i.e., "Forward/Command message") and from secondary processor 356 to primary processor 310 (i.e., "Backward/Return message") complies with the same message format 500. Each message may be considered to be a communication frame, and the terms "message" and "frame" may be used interchangeably here.

Message format 500 is as follows:

[SOF/MSGL]-[CMD/RESP]-([DATA(0)] . . . [DATA(x)]}-[CRC2]-[(CRC 1/2)/EOF], where symbols in the brackets indicate one byte. If, as explained in the example above, the maximum message length is 10 bytes, then it is apparent that from FIG. 5 that the maximum length of the data payload ([DATA(0)] . . . [DATA(x)]} is six (6) bytes.

In FIG. 5: SOF is a Start-Of-Frame Field 510 that indicates the start of the message; MSGL is a Message Length Field 520 that indicates the number of bytes in the current message (excluding the SOF Field, the MSGL Field, the CRC1/2 Field and the EOF field); CMD is a Command Field 530 that includes a specific command from a set of allowed commands; RESP is a Response Field 540 that indicates a specific expected response; DATA is a Data Field 550 of from zero to six bytes of payload data associated with the specified command or response; CRC2 is a CRC Field 560 that includes a lower 8 bits of a 16 bit cyclical redundancy check value for the message; CRC1/2 is another CRC Field that includes half of an upper 8 bits of the 16 bit cyclical redundancy check value for the message; and EOF is an End-of-Frame field 580 that indicates the end of the message.

In the example embodiment, the SOF Field has a length of four bits, and has a predefined value of 0x01; the MSGL Field has a length of four bits and may have values ranging from 1 to 8; the CMD Field has a length of four bits, supporting up to 16 different commands; the RESP Field has a length of four bits, supporting up to 16 different responses; the DATA Field is variable length field of from zero to six bytes, which may include payload data and which may include the upper four bits of the cyclical redundancy check value for the message; the CRC2 Field is an 8 bit field; the CRC1/2 Field is a four bit field; and the EOF field is also a four bit field.

Beneficially, with the message format 500, once a processor receives a message and checks the MSGL filed, the processor can easily identify where all of the other fields begin and end within the message. Furthermore, by examining the CMD Field and the RESP Field, the processor can determine the nature of the data included in the DATA Field.

As can be seen from FIG. 5, according to the symmetrical message-based communication protocol with messages according to message format 500, each message includes a CMD Field for communicating a command, and a RESP Field which may communicate a response that is expected for the command. The CMD Field may include a command selected from a set of allowed commands according to the communication protocol. Table 2 below is a Commands Table illustrating the set of allowed commands that may be included in the CMD field of a message according to an embodiment of the communication protocol. With a four bit CMD Field, the set of allowed commands may include up to sixteen different commands.

TABLE 2

Commands Table

| CMD FIELD | | |
|---|---|---|
| | DESCRIPTION OF COMMAND | Forward/Command:<br>[SOF / MSGL] - [CMD / RESP] - DATA[0-x] - CRC2 - [(CRC1/2) / EOF] :<br>Payload of up to 6 bytes |
| 0x22 | SET SECONDARY PROCESSOR STATE | [SOF / MSGL] - [CMD / RESP] - [ ((CRC1)/2),DATA[0] ] - CRC2 - [(CRC1/2) / EOF]<br>4 bit value Processor State.<br>State Values:<br>0: Set Secondary Active - All Secondary events active, send all monitored info to Primary.<br>1: Set Secondary Standby - Do not send anything to the Primary<br>2: Critical Monitor Only - Send to Primary only Iout1, Iout2.<br>3: Power OFF - Expect Power loss, do soft stop.<br>4: Reset - Perform software reset. |
| | D0 | Upper 4 bits hold the upper 4 bits of CRC1, remainder 0<br>Note: When calculating CRC these upper 4 bits need to be set to 0.<br>Lower 4 bits indicate the Secondary State to be set.<br>Secondary States value could be {0, ..., 4}. Expandable to 0xF. |
| | Example:<br>Set Secondary Active | [1,3] - [2,RESP] - [(CRC1)/2,0] - CRC2 - [( (CRC1)/2 ),4] →<br>[1,3] - [2,RESP] - [Z,0] - CRC2 - [Z',4]<br>[SOF / MSGL] = 0x13 → SOF = 0x1, MSGL = 0x3<br>[CMD / RESP] = 0x0R → CMD = 0x2, RESP = 0xR where R={0x0,..,0xF}.<br>[ ((CRC1)/2),DATA[0] ] = 0xZ0 → (CRC1)/2 = 0xZ, DATA[0] = 0x0<br>where Z = The upper 4 bits of CRC1 & Z' is the Lower 4 bits.<br>CRC2 = 0xYY → Where 0xYY is the lower 8 bits of CRC16.<br>[(CRC1/2) / EOF] = 0xW4 → (CRC1)/2 = 0xW, EOF = 0x4 where W = The lower 4 bits of CRC1.<br>Return the requested Response (RESP). Refer to the Response Table (Table 3) for a list of responses. |

TABLE 2-continued

| Commands Table | | |
|---|---|---|
| CMD FIELD | | |
| 0x11 | IS SECONDARY READY? | [SOF / MSGL] - [CMD / RESP] - [ ((CRC1)/2),DATA[0] ] - CRC2 - [(CRC1/2) / EOF] |
| | D0 | Upper 4 bits hold the upper 4 bits of CRC1.<br>Note: When calculating CRC these upper 4 bits need to be set to 0.<br>Lower 4 bits are set to the channel (PWMx, ADCx, etc.) or are set to 0 if not used. |
| | Example:<br>Start all Secondary operations and expect Power ON.<br>Note:<br>A suggested RESP is: "READ ALL RSET ADC" (see Table 3 below)<br>This will get the necessary info before changing the Secondary Processor's state from "Stand by" to "Active" with the "Set Secondary Processor State" command (see above). | [1,3] - [1,RESP] - [Z,0] - CRC2 - [Z',4]<br>[SOF / MSGL] = 0x13 → SOF = 0x1, MSGL = 0x3<br>[CMD / RESP] = 0x1R → CMD = 0x1, RESP = 0xR where R={0x0,..,0xF}.<br>[ ((CRC1)/2),DATA[0] ] = 0xZ0 → (CRC1)/2 = 0xZ, DATA[0] = 0x0 (No data necessary, set to 0 for simplicity)<br>Where Z = The upper 4 bits of CRC1 & Z' is the Lower 4 bits of CRC1.<br>CRC2 = 0xYY → Where 0xYY is the lower 8 bits of CRC16.<br>[(CRC1/2) / EOF] = 0xW4 → (CRC1)/2 = 0xW, EOF = 0x4<br>Where W = The lower 4 bits of CRC1.<br>Return the requested Response (RESP). Refer to the Response Table (Table 3) for a list of responses. |
| 0x00 | RESPONSE MESSAGE (Incoming Response to Earlier Command sent)<br>This is a Response that needs to be handled according to the Response Table (Table 3). | [SOF / MSGL] - [CMD / RESPR] - DATA[0-x] - CRC2 - [(CRC1/2) / EOF]<br>Return (incoming) of the requested Response (RESP) from an outgoing Command (CMD) sent. Refer to the Response Table (Table 3) for a list of responses. The protocol allows getting any valid response type RESP for each & every valid command CMD.<br>Note: The most frequent frame or message is the Response Message. A CMD Field = 0 was chosen to make the CRC calculation easier and to eliminate additional driving requirements for the electronics. |
| 0xE14 | RESERVED | Expansion possibility for an additional 15 Responses or Commands. |
| 0xD13 | SET REMOTE PWM | [SOF / MSGL] - [CMD / RESP] - [ ((CRC1)/2),DATA[0] ] - D1 - D2 - CRC2 - [(CRC1/2) / EOF] |
| | D0 | Upper 4 bits hold the upper 4 bits of CRC1.<br>Note: When calculating CRC these upper 4 bits need to be set to 0.<br>Lower 4 bits indicate the PWM number to be set. PWM value could be 0,1,2,3. |
| | D1 | Upper 8 bits of the PWM value |
| | D2 | Lower 8 bits of the PWM value |
| | Example:<br>Set remote PWM1 to 0x2345.<br>(Provides Support for 16 bit PWM). | [1,5] - [13,RESP] - [Z,1] - 35 - 69 - CRC2 - [Z',4]<br>[SOF / MSGL] = 0x15 → SOF = 0x1, MSGL = 0x5<br>[CMD / RESP] = 0xDR → CMD = 0xD, RESP = 0xR<br>Where R={0x0, ..., 0xF}.<br>[ ((CRC1)/2),DATA[0] ] = 0xZ1 → (CRC1)/2 = 0xZ, DATA[0] = 0x1 (PWM=1)<br>Where Z = The upper 4 bits of CRC1 & Z' is the Lower 4 bits.<br>D1 = 0x23 = 35<br>D2 = 0x45 = 69<br>CRC2 = 0xYY → Where 0xYY is the lower 8 bits of CRC16.<br>[(CRC1/2) / EOF] = 0xW4 → (CRC1)/2 = 0xW, EOF = 0x4<br>Where W = The lower 4 bits of CRC1.<br>Return the requested Response (RESP). Refer to the Response Table (Table 3) for a list of responses. |
| 0xC12 | SET REMOTE I/O | [SOF / MSGL] - [CMD / RESP] - [ ((CRC1)/2),DATA[0] ] - D1 - CRC2 - [(CRC1/2) / EOF] |
| | D0 | Upper 4 bits hold the upper 4 bits of CRC1.<br>Note: When calculating CRC these upper 4 bits need to be set to 0.<br>Lower 4 bits indicate the I/O number to be set. I/O value could be 0,1,2,3. Expandable to 15 I/O. |

TABLE 2-continued

| Commands Table | | |
|---|---|---|
| CMD FIELD | | |
| | D1<br>Example:<br>Set remote I/O[2] = Hi. | Value to be used for the I/O = {0,1}.<br>[1,4] - [12,RESP] - [Z,2] - 1 - CRC2 - [Z',4]<br>[SOF / MSGL] = 0x14 → SOF = 0x1, MSGL = 0x4<br>[CMD / RESP] = 0xDR → CMD = 0xD, RESP = 0xR<br>Where R={0x0, ..., 0xF}.<br>[ ((CRC1)/2),DATA[0] ] = 0xZ1 → (CRC1)/2 = 0xZ, DATA[0] = 0x2 (I/O=2)<br>Where Z = The upper 4 bits of CRC1 & Z' is the Lower 4 bits.<br>D1 = 0x01 = 1<br>CRC2 = 0xYY → Where 0xYY is the lower 8 bits of CRC16.<br>[(CRC1/2) / EOF] = 0xW4 → (CRC1)/2 = 0xW, EOF = 0x4<br>Where W = The lower 4 bits of CRC1.<br>Return the requested Response (RESP). Refer to the Response Table (Table 3) for a list of responses. |
| 0x44 | SET DEMO MODE | [SOF / MSGL] - [CMD / RESP] - [ ((CRC1)/2),DATA[0] ] - CRC2 - [(CRC1/2) / EOF]<br>4 bit value<br>Demo Mode Values:<br>0: Demo Stop - Return to normal operation.<br>1: Demo (1) - User defined.<br>2: Demo (2) - User defined.<br>3: Demo (3) - User defined. |
| | D0 | Upper 4 bits hold the upper 4 bits of CRC1, remainder 0<br>Note: When calculating CRC these upper 4 bits need to be set to 0.<br>Lower 4 bits indicate the Demo Mode Value to be set.<br>Secondary States value could be 0,1,2,3. Expandable to 0xF. |
| | Example:<br>Set Demo Mode 3. | [1,3] - [4,RESP] - [Z,3] - CRC2 - [Z',4]<br>[SOF / MSGL] = 0x13 → SOF = 0x1, MSGL = 0x3<br>[CMD / RESP] = 0x3R → CMD = 0x3, RESP = 0xR<br>where R={0x0,..,0xF}.<br>[ ((CRC1)/2),DATA[0] ] = 0xZ3 → (CRC1)/2 = 0xZ, DATA[0] = 0x3<br>Where Z = The upper 4 bits of CRC1 & Z' is the Lower 4 bits.<br>CRC2 = 0xYY → Where 0xYY is the lower 8 bits of CRC16.<br>[(CRC1/2) / EOF] = 0xW4 → (CRC1)/2 = 0xW, EOF = 0x4<br>Where W = The lower 4 bits of CRC1.<br>Return the requested Response Data (RESP). Refer to the Response Table (Table 3) for a list of responses. |
| 0x55 | GET RESPONSE ONLY<br>D0 | [SOF / MSGL] - [CMD / RESP] - [ ((CRC1)/2),DATA[0] ] - CRC2 - [(CRC1/2) / EOF]<br>Upper 4 bits hold the upper 4 bits of CRC1.<br>Note: When calculating CRC these upper 4 bits need to be set to 0.<br>Lower 4 bits are set to the channel (PWMx, ADCx, etc.) or are set to 0 if not used. |
| | Example:<br>Get Response "Read ADC" {Iout1, Iout2}. | [1,3] - [5,0] - [Z,0] - CRC2 - [Z',4]<br>[SOF / MSGL] = 0x12 → SOF = 0x1, MSGL = 0x2<br>[CMD / RESP] = 0x30 → CMD = 0x3, RESP = 0x0<br>[ ((CRC1)/2),DATA[0] ] = 0xZ0 → (CRC1)/2 = 0xZ, DATA[0] = 0x0<br>Where Z = The upper 4 bits of CRC1 & Z' is the Lower 4 bits.<br>CRC2 = 0xYY → Where 0xYY is the lower 8 bits of CRC16.<br>[(CRC1/2) / EOF] = 0xW4 → (CRC1)/2 = 0xW, EOF = 0x4<br>Where W = The lower 4 bits of CRC1.<br>Return the requested Response Data (RESP). Refer to the Response Table (Table 3) for a list of responses. |

The RESP Field may include a response selected from a set of allowed responses according to the communication protocol. Table 3 below is a Responses Table illustrating the set of allowed responses that may be included in the RESP field of a message according to an embodiment of the communication protocol. With a four bit RESP Field, the set of allowed responses may include up to sixteen different responses.

TABLE 3

Responses Table

| RESP | | |
|---|---|---|
| | ( BACKWARD FRAME / RETURN ) REQUEST | Returned Frame<br>[SOF / MSGL] - [CMD / RESP] - DATA[0-x] - CRC2 - [(CRC1/2) / EOF] :<br>(Payload of 6 bytes )<br>Notes:<br>a. SOF will be the upper 4 bits and MSGL will be the lower 4 bits. This is possible since the maximum frame will be 10 bytes.<br>b. CMD will be the upper 4 bits and RESP will be the lower 4 bits. This will limit the maximum number of commands & responses to 16 each.<br>c. Since Iout [1,2] will always be included in Data[0,..,3] use 24 bits for the current and the additional 4 bits for the CRC1 four upper bits. Also the EOF is 4 bits, and the additional 4 bits are used for the lower CRC1 4 bits. |
| 0x022 | REQUEST NO RESPONSE | There will be nothing returned to the frame originator. |
| 0x033 | Request for Valid frame Receipt acknowledgment (ACK).<br>Can be used as a "Secondary Ready" indication.<br>Note:<br>The character for ACK is 0x06. We will use 0x6 for optimization. | [SOF / MSGL] - [CMD / RESP] - DATA[0] - CRC2 - [((CRC1)/2) / EOF] |
| | Example:<br>Receive ACK Frame. | [1,3] - [0,3] - [Z,6] - CRC2 - [Z',4]<br>[SOF / MSGL] = 0x13 → SOF = 0xl, MSGL = 0x3<br>[CMD / RESP] = 0x03 → CMD = 0x0, RESP = 0x3<br>[ ((CRC1)/2),DATA[0] ] = 0xZ6 → (CRC1)/2 = 0xZ, DATA[0] = 0x6 = (ACK)<br>Where Z = The upper 4 bits of CRC1 & Z' is the Lower 4 bits.<br>CRC2 = 0xYY → Where 0xYY is the lower 8 bits of CRC16.<br>[(CRC1/2) / EOF] = 0xW4 → (CRC1)/2 = 0xW, EOF = 0x4<br>Where W = The lower 4 bits of CRC1. |
| 0x11 | READ ALL RSET ADC Rset{1,2,3}<br>12bit each max<br>Example:<br>Rset 1 = 1023 = 0x3FF<br>Rset 2 = 23 = 0x017<br>Rset 3 = 910 = 0x38E | [SOF, MSGL] - [CMD, RESP] - [((CRC1)/2), ((Rset1)/3)]- DATA[1] - DATA[2] - DATA[3] - DATA[4] - DATA[5] - CRC2 - [((CRC1)/2), EOF]<br>[1,8] - [0,1] - [Z,3] - 0xFF - 0x00 - 0x17 - 0x03 - 0x8E - CRC2 - [Z',4] →<br>0x18 - 0x01 - 0xZ3 - 0xFF - 0x00 - 0x17 - 0x03 - 0x8E - CRC2 - 0xZ'4<br>[SOF / MSGL] = 0x18 → SOF = 0x1, MSGL = 0x8<br>[CMD / RESP] = 0x01 → CMD = 0x0, RESP = 0x1<br>[ ((CRC1)/2),DATA[0] ] = 0xZ3 → (CRC1)/2 = 0xZ,<br>Where Z =The upper 4 bits of CRC1 & Z' is the Lower 4 bits.<br>Rset1=0x3FF → DATA[0] = 0x3, DATA[1] = 0xFF<br>Rset2=0x017 → DATA[2] = 0x00, DATA[3] = 0x17<br>Rset3=0x38E → DATA[4] = 0x03, DATA[5] = 0x8E<br>CRC2 = 0xYY → Where 0xYY is the lower 8 bits of CRC16.<br>[(CRC1/2) / EOF] = 0xW4 → (CRC1)/2 = 0xW, EOF = 0x4<br>Where W = The lower 4 bits of CRC1. |
| 0x00 | READ ADC {Iout1, Iout2} | [SOF, MSGL] - [CMD, RESP] - [((CRC1)/2), ((Iout1)/3)]- DATA[1] - DATA[2] - DATA[3] - CRC2 - [((CRC1)/2), EOF] |

TABLE 3-continued

| Responses Table | | |
|---|---|---|
| RESP | | |
| | Example:<br>Iout 1 = 1023 = 0x3FF<br>Iout 2 = 910 = 0x38E | [1,6] - [0,0] - [Z,0x3] - 0xFF - 0x03 - 0x8E - CRC2 - [Z',4]<br>4→<br>0x16 - 0x00 - 0xZ3 - 0xFF - 0x03 - 0x8E - CRC2 - 0xZ'4<br>[SOF / MSGL] = 0x16 → SOF = 0x1, MSGL = 0x6<br>[CMD / RESP] = 0x00 → CMD = 0x0, RESP = 0x0<br>[ ((CRC1)/2),DATA[0] ] = 0xZ3 → (CRC1)/2 = 0xZ,<br>Where Z = The upper 4 bits of CRC1 & Z' is the Lower 4 bits.<br>Iout 1 =0x3FF → DATA[0] = 0x3, DATA[1] = 0xFF<br>Iout 2=0x38E → DATA[4] = 0x03, DATA[5] = 0x8E<br>CRC2 = 0xYY → Where 0xYY is the lower 8 bits of CRC16.<br>[(CRC1/2) / EOF] = 0xW4 → (CRC1)/2 = 0xW, EOF = 0x4<br>Where W = The lower 4 bits of CRC1. |
| 0x44 | READ ADC<br>{Iout1, Iout2, Vout1} | [SOF, MSGL] - [CMD, RESP] - [((CRC1)/2), ((Iout1)/3)<br>]- DATA[1] - DATA[2] - DATA[3] - DATA[4] -<br>DATA[5] -CRC2 - [((CRC1)/2), EOF] |
| | Example:<br>Iout1 = 1023 = 0x3FF<br>Iout2 = 23 = 0x017<br>Vout1 = 910 = 0x38E | [1,8] - [0,4] - [Z,0x3] - 0xFF - 0x00 - 0x17 - 0x03 - 0x8E - CRC2 - [Z',4]<br>[SOF / MSGL] = 0x18 → SOF = 0x1, MSGL = 0x8<br>[CMD / RESP] = 0x04 → CMD = 0x0, RESP = 0x4<br>[ ((CRC1)/2),DATA[0] ] = 0xZ3→ (CRC1)/2 = 0xZ,<br>Where Z = The upper 4 bits of CRC1 & Z' is the Lower 4 bits.<br>Iout1=0x3FF → DATA[0] = 0x3, DATA[1] = 0xFF<br>Iout2=0x017 → DATA[2] = 0x00, DATA[3] = 0x17<br>Vout1=0x38E → DATA[4] = 0x03, DATA[5] = 0x8E<br>CRC2 = 0xYY → Where 0xYY is the lower 8 bits of CRC16.<br>[(CRC1/2) / EOF] = 0xW4 → (CRC1)/2 = 0xW, EOF = 0x4<br>Where W = The lower 4 bits of CRC1. |
| 0x55 | READ ADC<br>{Iout1, Iout2, Vout2} | [SOF, MSGL] - [CMD, RESP] - [((CRC1)/2), ((Iout1)/3)<br>]- DATA[1] - DATA[2] - DATA[3] - DATA[4] -<br>DATA[5] -CRC2 - [((CRC1)/2), EOF] |
| | Example:<br>Iout1 = 1023 = 0x3FF<br>Iout2 = 23 = 0x017<br>Vout2 = 910 = 0x38E | [1,8] - [0,5] - [Z,0x3] - 0xFF - 0x00 - 0x17 - 0x03 - 0x8E - CRC2 - [Z',4]<br>[SOF / MSGL] = 0x18 → SOF = 0x1, MSGL = 0x8<br>[CMD / RESP] = 0x05 → CMD = 0x0, RESP = 0x5<br>[ ((CRC1)/2),DATA[0] ] = 0xZ3 → (CRC1)/2 = 0xZ,<br>Where Z = The upper 4 bits of CRC1 & Z' is the Lower 4 bits.<br>Iout1=0x3FF → DATA[0] = 0x3, DATA[1] = 0xFF<br>Iout2=0x017 → DATA[2] = 0x00, DATA[3] = 0x17<br>Vout2=0x38E → DATA[4] = 0x03, DATA[5] = 0x8E<br>CRC2 = 0xYY → Where 0xYY is the lower 8 bits of CRC16.<br>[(CRC1/2) / EOF] = 0xW4 → (CRC1)/2 = 0xW, EOF = 0x4<br>Where W = The lower 4 bits of CRC1. |
| 0x66 | READ ADC<br>{Iout1, Iout2, TC} | [SOF, MSGL] - [CMD, RESP] - [((CRC1)/2), ((Iout1)/3)<br>]- DATA[1] - DATA[2] - DATA[3] - DATA[4] -<br>DATA[5] -CRC2 - [((CRC!)/2), EOF] |
| | Example:<br>Iout1 = 1023 = 0x3FF<br>Iout2 = 23 = 0x017<br>TC = 910 = 0x38E | [1,8] - [0,6] - [Z,0x3] - 0xFF - 0x00 - 0x17 - 0x03 - 0x8E - CRC2 - [Z',4]<br>[SOF / MSGL] = 0x18 → SOF = 0x1, MSGL = 0x8<br>[CMD / RESP] = 0x06 → CMD = 0x0, RESP = 0x6<br>[ ((CRC1)/2),DATA[0] ] = 0xZ3 → (CRC1)/2 = 0xZ,<br>Where Z = The upper 4 bits of CRC1 & Z' is the Lower 4 bits.<br>Iout1=0x3FF → DATA[0] = 0x3, DATA[1] = 0xFF<br>Iout2=0x017 → DATA[2] = 0x00, DATA[3] = 0x17<br>TC=0x38E → DATA[4] = 0x03, DATA[5] = 0x8E<br>CRC2 = 0xYY → Where 0xYY is the lower 8 bits of CRC16.<br>[(CRC1/2) / EOF] = 0xW4 → (CRC1)/2 = 0xW, EOF = 0x4<br>Where W = The lower 4 bits of CRC1. |
| 0x77 | READ ADC<br>{Iout1, Iout2, ADC#} | [SOF, MSGL] - [CMD, RESP] - [((CRC1)/2), ((Iout1)/3)<br>]- DATA[1] -DATA[2] - DATA[3] - DATA[4] -<br>DATA[5] -CRC2 [((CRC1)/2), EOF] |

TABLE 3-continued

| Responses Table | | |
|---|---|---|
| RESP | | |
| | Example:<br>Iout1 = 1023 = 0x3FF<br>Iout2 = 23 = 0x017<br>ADC2 = 910 = 0x38E<br>ADC number to read is 2. | [1,8] - [0,7] - [Z,0x3] - 0xFF - 0x00 - 0x17 - 0x03 - 0x8E - CRC2 - [Z',4]<br>[SOF / MSGL] = 0x18 → SOF = 0xl, MSGL = 0x8<br>[CMD / RESP] = 0x07 → CMD = 0x0, RESP = 0x7<br>[ ((CRC1)/2),DATA[0] ] = 0xZ3 → (CRC1)/2 = 0xZ, Where Z = The upper 4 bits of CRC1 & Z' is the Lower 4 bits.<br>Iout1=0x3FF → DATA[0] = 0x3, DATA[1] = 0xFF<br>Iout2=0x017 → DATA[2] = 0x00, DATA[3] = 0x17<br>ADC2=0x38E → DATA[4] = 0x23, DATA[5] = 0x8E<br>Upper 4 bits are the ADC number.<br>CRC2 = 0xYY → Where 0xYY is the lower 8 bits of CRC16.<br>[(CRC1/2) / EOF] = 0xW4 → (CRC1)/2 = 0xW, EOF = 0x4<br>Where W = The lower 4 bits of CRC1. |
| 0x88 | READ PWM<br>{Iou1, Iout2, PWM#}<br>12 bit max<br>Example:<br>Iout1 = 1023 = 0x3FF<br>Iout2 = 23 = 0x017<br>PWM4 = 910 = 0x38E<br>PWM number to read is 4. | [SOF, MSGL] - [CMD, RESP] - [((CRC1)/2), ((Iout1)/3) ]- DATA[1] - DATA[2] - DATA[3] - DATA[4] - DATA[5] -CRC2 - [((CRC1)/2). EOF]<br>[1,8] - [0,8] - [Z,0x3] - 0xFF - 0x00 - 0x17 - 0x03 - 0x8E - CRC2 - [Z',4]<br>[SOF / MSGL] = 0x18 → SOF = 0x1, MSGL = 0x8<br>[CMD / RESP] = 0x08 → CMD = 0x0, RESP = 0x8<br>[ ((CRC1)/2),DATA[0] ] = 0xZ3 → (CRC1)/2 = 0xZ, Where Z = The upper 4 bits of CRC1 & Z' is the Lower 4 bits.<br>Iout1=0x3FF → DATA[0] = 0x3, DATA[1] = 0xFF<br>Iout2=0x017 → DATA[2] = 0x00, DATA[3] = 0x17<br>PWM4=0x38E → DATA[4] = 0x43, DATA[5] = 0x8E<br>Upper 4 bits are the PWM number.<br>CRC2 = 0xYY → Where 0xYY is the lower 8 bits of CRC16.<br>[(CRC1/2) / EOF] = 0xW4 → (CRC1)/2 = 0xW, EOF = 0x4<br>Where W = The lower 4 bits of CRC1. |
| 0x99 | READ I/O<br>{Iout1, Iout2, I/O#}<br><br>Example:<br><br>Iout1 = 1023 = 0x3FF<br>Iout2 = 23 = 0x017<br>Receive I/O 3 is High.<br>0: is Low<br>1: is High<br>2: is a PWM<br>3: is an ADC<br>5: Error<br>Default return is Error for not supported I/O by the application. | [SOF, MSGL] - [CMD, RESP] - [((CRC1)/2), ((Iout1)/3) ]- DATA[1] - DATA[2] - DATA[3] - DATA[4] - CRC2 - [((CRC1)/2), EOF]<br>[1,7] - [0,9] - [Z,0x3] - 0xFF - 0x00 - 0x17 - 0x31 - CRC2 -<br>[Z',4]<br>[SOF / MSGL] = 0x17 → SOF = 0xl, MSGL = 0x7<br>[CMD / RESP] = 0x09 → CMD = 0x0, RESP = 0x9<br>[ ((CRC1)/2),DATA[0] ] = 0xZ3 → (CRC1)/2 = 0xZ, Where Z = The upper 4 bits of CRC1 & Z' is the Lower 4 bits.<br>Iout1=0x3FF → DATA[0] = 0x3, DATA[1] = 0xFF<br>Iout2=0x017 → DATA[2] = 0x00, DATA[3] = 0x17<br>DATA[4] = 0x31 → I/O number =0x3, I/O Status=0x1.<br>Upper 4 bits are the I/O number.<br>CRC2 = 0xYY → Where 0xYY is the lower 8 bits of CRC16.<br>[(CRC1/2) / EOF] = 0xW4 → (CRC1)/2 = 0xW, EOF = 0x4<br>Where W = The lower 4 bits of CRC1. |
| 0xA10 | READ VERSION<br>version info consists of : {major, minor, revision, protocol version}<br><br>Example:<br><br>Major = 0x03<br>Minor = 0x0046<br>Revision = 0x002D<br>Protocol revision = 0x01 | [SOF, MSGL] - [CMD, RESP] - [((CRC1)/2), DATA[0] ]- DATA[1] - DATA[2] - DATA[3] - DATA[4] - DATA[5] - DATA[6] - CRC2 - [((CRC1)/2), EOF]<br>NOTE: This RESP=0xA should not be used while in Iout sampling mode. For this reason, one extra byte of payload is allowed.<br>[1,9] - [0,0xA] - [Z,0x0] - 0x03 - 0x00 - 0x46 - 0x00 - 0x2D<br>- 0x01 - CRC2 - [Z',4]<br>[SOF / MSGL] = 0x19 → SOF = 0xl, MSGL = 0x9<br>[CMD / RESP] = 0x0A → CMD = 0x0, RESP = 0xA<br>[ ((CRC1)/2),RESERVED ] = 0xZ0 → (CRC1)/2 = 0xZ, Where Z = The upper 4 bits of CRC1 & Z' is the Lower 4 bits.<br>DATA[0] = Reserved=0,<br>Major = 0x03 → DATA[1] = 0x03<br>Minor = 0x0046 → DATA[2] = 0x00, DATA[3] = 0x46<br>Revision = 0x002D → DATA[4] = 0x00, DATA[5] = 0x2D<br>protocol revision=0x01 → DATA[6] = 0x01<br>CRC2 = 0xYY → Where 0xYY is the lower 8 bits of CRC16.<br>[(CRC1/2) / EOF] = 0xW4 → (CRC1)/2 = 0xW, EOF = 0x4<br>Where W = The lower 4 bits of CRC1. |

As noted above, each message/frame is checked with a 16-bit (two byte) cyclic redundancy check (CRC).

In some embodiments, a processor (e.g., a primary processor or a secondary processor, as described above) which is transmitting a message/frame may calculate the CRC for the message/frame in real time according to an algorithm shown in Table 4, below:

TABLE 4

```
unsigned int Calc_CRC(int *ptr, int count)
{
  // NOTE: CRC-CCITT (XModem)
  unsigned long int crc;
  unsigned short c;
  unsigned int crc_rtn;
  int i=0;
  unsigned long int data[32]={0};
  crc=0;
  i=0;
  for (i=count-1; i >= 0; i--)
  {
    data[i]= (( unsigned long int ) *ptr++ & 0x00FF);
  }
  while(--count >= 0)
  {
    crc = crc ^ (data[count] << 8);
    i=8;
    do
    {
        c = ((unsigned short) i) << 8;
        if( (crc ^ c) & 0x8000)
      {
          crc = ( (crc << 1) ^ 0x1021 );
      }
      else
      {
          crc = ( crc << 1 ) ;
        }
    }while(--i);
  }
  crc_rtn = ( (unsigned int) crc & 0xFFFF );
  return (crc_rtn);
}
```

In some embodiments, a receiving processor (e.g., a primary processor or a secondary processor, as described above) which is receiving a message/frame may check the CRC for the received message/frame in real time according to an algorithm shown in Table 5, below:

TABLE 5

```
int SOF = 0;
unsigned int CRC_calc=0;
CRC_calc = Calc_CRC ( &data[SOF+2], sizeof(data) -3);
if(((CRC_calc & 0x00FF) == CRC2) && (((CRC_calc & 0xFF00)
>> 8 ) == CRC1))
{
  CRC_valid = TRUE;
}
else
{
  CRC_valid = FALSE;
}
```

Although the communication protocol described above has been described in detail with respect to a lighting system with LED lighting units, the communication protocol has broader applicability for communications between embedded processors, particularly with respect to power electronics systems, for example in lighting systems that use ballasts and/or or drivers, including those with high intensity discharge (HID) light sources, fluorescent light sources, semiconductor-based light sources, etc.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

It should also be understood that, unless clearly indicated to the contrary, in any methods claimed herein that include more than one step or act, the order of the steps or acts of the method is not necessarily limited to the order in which the steps or acts of the method are recited.

Also, reference numerals appearing in the claims in parentheses, if any, are provided merely for convenience and should not be construed as limiting in any way.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

What is claimed is:

1. A system, comprising:

a lighting unit, including, a lighting driver, and a lighting module supplied with power by the lighting driver, the lighting module including, one or more light sources, one or more sensors for sensing data indicating one or more operating parameters of the lighting module, and a secondary processor configured to receive the sensed data indicating the one or more operating parameters of the lighting module; and a primary processor configured to monitor the one or more operating parameters of the lighting module, wherein the primary processor and the secondary processor communicate with each other according to a message-based communication protocol wherein each message communicated between the primary processor and the secondary processor has an identical message format and includes a command field and a response field wherein the response field is provided for indicating a response to a command.

2. The system of claim 1, wherein each message further includes:

a start of frame field;

an end of frame field;

a message length field; and cyclical redundancy check bits for an entire balance of the message except for the CRC bits themselves and the start of frame, end of frame, and message length fields.

3. The system of claim 1, wherein the one or more operating parameters include a current provided to at least one of the one or more light sources, a voltage provided to at least one of the one or more light sources, and an operating temperature of the lighting module, and wherein the one or more light sources include at least two light sources.

4. The system of claim 1, wherein the command field includes a command selected from a set of allowed commands, wherein the set of allowed commands includes: setting a state of the secondary processor to one of a set of designated states; requesting an acknowledgement from the secondary processor indicating whether the lighting module is ready for operation; setting a pulse width modulation value for a pulse width modulator included in the lighting unit; and requesting that the secondary processor communicate a selected set of the sensed data from among a group of designated sets of sensed data.

5. The system of claim 4, wherein the set of allowed commands further includes setting the lighting module into a demonstration mode.

6. The system of claim 4, wherein the set of designated states include an active state, a standby state, a reset state, a power down state, and a current monitor only state.

7. The system of claim 4, wherein the one or more light sources include at least first and second light sources, and wherein the designated sets of sensed data include: first and second currents applied to the first and second light sources; the first and second currents applied to the first and second light sources and a first voltage applied to the first light source; the first and second currents applied to the first and second light sources and a second voltage applied to the second light source; the first and second currents applied to the first and second light sources and a temperature of the lighting module; and the first and second currents applied to the first and second light sources and a pulse width modulation value of a pulse width modulator included in the lighting unit.

8. The system of claim 1, wherein the message format is: [SOF/MSGL]-[CMD/RESP]-([DATA(0)] . . . [DATA(x)]}-[CRC2]-[(CRC1/2)/ EOF], where: SOF indicates a start of the message, MSGL indicates a length of the message, CMD indicates a specific command, RESP indicates a specific expected response, DATA indicates data associated with the specified command or response, CRC2 indicates a lower 8 bits of a 16 bit cyclical redundancy check value for the message, CRC1/2 indicates half of an upper 8 bits of the 16 bit cyclical redundancy check value for the message, and EOF indicates an end of the message.

9. The system of claim 1, wherein the lighting unit further includes a pulse width modulator for adjusting an output level of the lighting driver, wherein the one or more operating parameters include a pulse width modulation value of the pulse width modulator.

10. The system of claim 1, wherein the lighting unit further includes an optical isolator configured to supply a feedback signal from the lighting module to the lighting driver.

11. The system of claim 1, wherein the secondary processor and the primary processor each include a universal asynchronous receiver/transmitter for communicating with each other.

12. The system of claim 1, wherein the command field includes the command.

13. The system of claim 12, further comprising an isolated interface, wherein the primary processor and the secondary processor communicate with each other via the isolated interface.

14. The system of claim 12, further comprising an optical isolator, wherein the primary processor and the secondary processor communicate with each other via the optical isolator.

15. A method, comprising:

at a secondary processor embedded in a lighting module that includes one or more light sources, receiving from a primary processor a first message communicated according to a message-based communication protocol wherein each message communicated between the primary processor and the secondary processor has an identical message format and includes a command field and a response field wherein the response field is provided for indicating a response to a command;

executing a first operation at the lighting module in response to a first command included in the command field of the first message; and sending from the secondary processor to the primary processor a second message according to the message-based communication protocol, wherein the second message includes in the response field a first response to the first command received in the first message.

16. The method of claim 15, wherein the first command comprises a request that the secondary processor send to the primary processor selected data sensed at the lighting module indicating one or more operating parameters of the lighting module, wherein executing the first operation at the lighting module includes sensing the selected data and wherein the second message further includes the selected data.

17. The method of claim 15, wherein the message format is: [SOF/MSGL]-[CMD/RESP]-([DATA(0)] . . . [DATA(x)]}-[CRC2]-[(CRC1/2)/EOF], wherein SOF indicates a start of the message, MSGL indicates a length of the message, CMD indicates a specific command, RESP indicates a specific expected response, DATA indicates data associated with the specified command or response, CRC2 indicates a lower 8 bits of a 16 bit cyclical redundancy check value for the message, CRC1/2 indicates half of an upper 8 bits of the 16 bit cyclical redundancy check value for the message, and EOF indicates an end of the message.

18. The method of claim 15, wherein the command is selected from a set of allowed commands, wherein the set of allowed commands includes: setting a state of the secondary processor to one of a set of designated states; requesting an acknowledgement from the secondary processor indicating whether the lighting module is ready for operation; setting a pulse width modulation value for a pulse width modulator employed for adjusting a current supplied to the lighting module; and requesting that the secondary processor communicate a selected set of the sensed data from among a group of designated sets of sensed data.

19. The method of claim 18, wherein the set of designated states include an active state, a standby state, a reset state, a power down state, and a current monitor only state.

20. The method of claim 18, wherein the one or more light sources include at least first and second light sources, and wherein the designated sets of sensed data include: first and second currents applied to the first and second light sources; the currents applied the first and second light sources and a first voltage applied to the first light source; the first and second currents applied to the first and second light sources and a second voltage applied to the second light source; the currents applied to the first and second light sources and a temperature of the lighting module; and the first and second currents applied to the first and second light sources and a pulse width modulation value of a pulse width modulator employed for adjusting the first and second currents.

21. The method of claim 15, wherein the first message further includes:

a start of frame field;

an end of frame field;

a message length field; and cyclical redundancy check bits for an entire balance of the message except for the CRC bits themselves and the start of frame, end of frame, and message length fields.

22. The method of claim 15, wherein the response field of the first message indicates the first response to the first command.

* * * * *